US007168477B2

(12) United States Patent
Salice

(10) Patent No.: US 7,168,477 B2
(45) Date of Patent: Jan. 30, 2007

(54) LIFTING APPARATUS FOR A TWO-LEAF FOLDING FLAP OR FOLDING DOOR

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 149 days.

(21) Appl. No.: 10/896,186

(22) Filed: Jul. 21, 2004

(65) Prior Publication Data

US 2005/0017224 A1 Jan. 27, 2005

(30) Foreign Application Priority Data

Jul. 21, 2003 (DE) ..... 203 11 189 U

(51) Int. Cl.
*E05D 15/26* (2006.01)

(52) U.S. Cl. ..... 160/213; 312/328

(58) Field of Classification Search ..... 160/213, 160/207, 188, 189; 312/328, 327, 323
See application file for complete search history.

(56) References Cited

U.S. PATENT DOCUMENTS 2,393,052 A * 1/1946 Mehard ..... 160/189
5,538,064 A * 7/1996 Salice ..... 160/201
5,882,099 A * 3/1999 Salice ..... 312/328
6,332,660 B1 * 12/2001 Salice ..... 312/328
6,877,830 B2 * 4/2005 Salice ..... 312/327

FOREIGN PATENT DOCUMENTS

| | | |
|---|---|---|
| CH | 341299 | 11/1959 |
| DE | 7705285 | 6/1977 |
| DE | 3026630 | 2/1982 |
| DE | 29604354 | 6/1996 |
| DE | 20100622 | 4/2001 |
| LU | 55310 | 1/1968 |

* cited by examiner

*Primary Examiner*—David Purol
(74) *Attorney, Agent, or Firm*—Dilworth & Barrese LLP

(57) ABSTRACT

The invention relates to a lifting apparatus for a two-leaf folding flap or folding door which can be pivoted about horizontal axes, consisting of a two-arm lever which is pivotably supported about a horizontal pivot axis on a side carcass part and whose longer arm is hinged to the lower leaf of the folding flap or folding door and of a pressure element whose one end is pivotably connected to the carcass part and whose other end is connected to the lever. In accordance with the invention, the longer lever arm of the two-arm lever is hingedly and displaceably connected to the lower leaf. Furthermore, the relative movement between the hinge point of the lever and the lower leaf is braked by a spring or friction force.

22 Claims, 3 Drawing Sheets

LIFTING APPARATUS FOR A TWO-LEAF FOLDING FLAP OR FOLDING DOOR

BACKGROUND OF THE INVENTION

The invention relates to a lifting apparatus for a two-panel folding flap or folding door which can be pivoted about horizontal axes. The lifting apparatus of the generic type consists of a two-arm lever which is pivotably supported on a lateral body part about a horizontal pivot axis and whose longer arm is hinged to the lower panel of the folding flap or folding door and of a pressure element whose one end is pivotably connected to the body part and whose other end is connected to the lever.

In a lever apparatus of the aforesaid type known from LU 55 310, the longer arm of the two-arm lever consists of two parts which can be telescoped relative to one another such that length changes of the lever arm, which occur on the opening or closing of the folding flap or folding door, can be compensated and can be controlled by actuation of the handle attached to the front side of the lower panel such that the lower panel does not abut the end face of the lateral body parts in its movement.

In DE 201 00 662 U for the guiding of the lower panel of the two-panel folding flap or folding door in a longitudinally displaceable manner on a pivot axis, the shorter lever arm is guided over a sliding piece or a roller in a cam guide fixed to the body in order thus to ensure that it does not abut the end faces of the body parts.

SUMMARY OF THE INVENTION

It is the object of the present invention to further develop an automatically opening lifting apparatus for two-panel folding flaps of the generic kind such that it can be manufactured in a cost-favorable manner by avoiding cam guides fixed to the body or telescopic parts. It must be taken into account that, on an automatic actuation of the lifting apparatus, the movement of the folding flap or folding door cannot be influenced or controlled due to the actuation of a handle.

This object is solved in accordance with the invention by the combination of the features of claim 1. Starting from a generic lifting apparatus, the longer lever arm of the two-arm lever is hingedly and displaceably connected to the lower panel, with it simultaneously being ensured that the relative movement between the hinge point of the lever and the lower panel being braked by spring force or friction force. In this solution, the displaceability of the joint connection serves to compensate the length change of the lever arm resulting during the pivot movement. However, such a connection has two degrees of freedom so that it is unstable overall. The second part of the solution comes into effect here, since this instability is eliminated in accordance with the invention due to the spring force or friction force. The lack of binding is compensated by the spring force or friction force since the required longitudinal displaceability in the elongate guide hole can only take place after overcoming the spring force or friction force. The thereby braked or damped hinge point now has the effect that the lower panel of the folding flap or folding door is pressed away or kept away from the end faces of the lateral body parts during the opening movement.

Preferred embodiments of the invention result from the description herein;

Accordingly, the longer lever arm of the two-arm lever and the lower panel of the two-panel folding flap or folding door can be connected to one another by an out-of-round bolt secured in a manner fixed against rotation to the longer lever arm, with the bolt being rotatably and longitudinally displaceably guided in an elongate hole guide of a support plate secured to the lower panel.

The bolt can be oval at least over a part of its length. In accordance with another aspect, the bolt can be made as round with opposite flattening arrangements over a part of its length.

The rims of the elongate hole guides cut out in the support plate are particularly advantageously lined with an elastic plastic. The clearance of the elongate hole guide corresponds in a particularly advantageous manner to the black diameter of the bolt.

BRIEF DESCRIPTION OF THE DRAWINGS

The lever apparatus can be drivable by means of an electric motor.

Further details and advantages result from the embodiment shown in the drawing.

Figure 1:
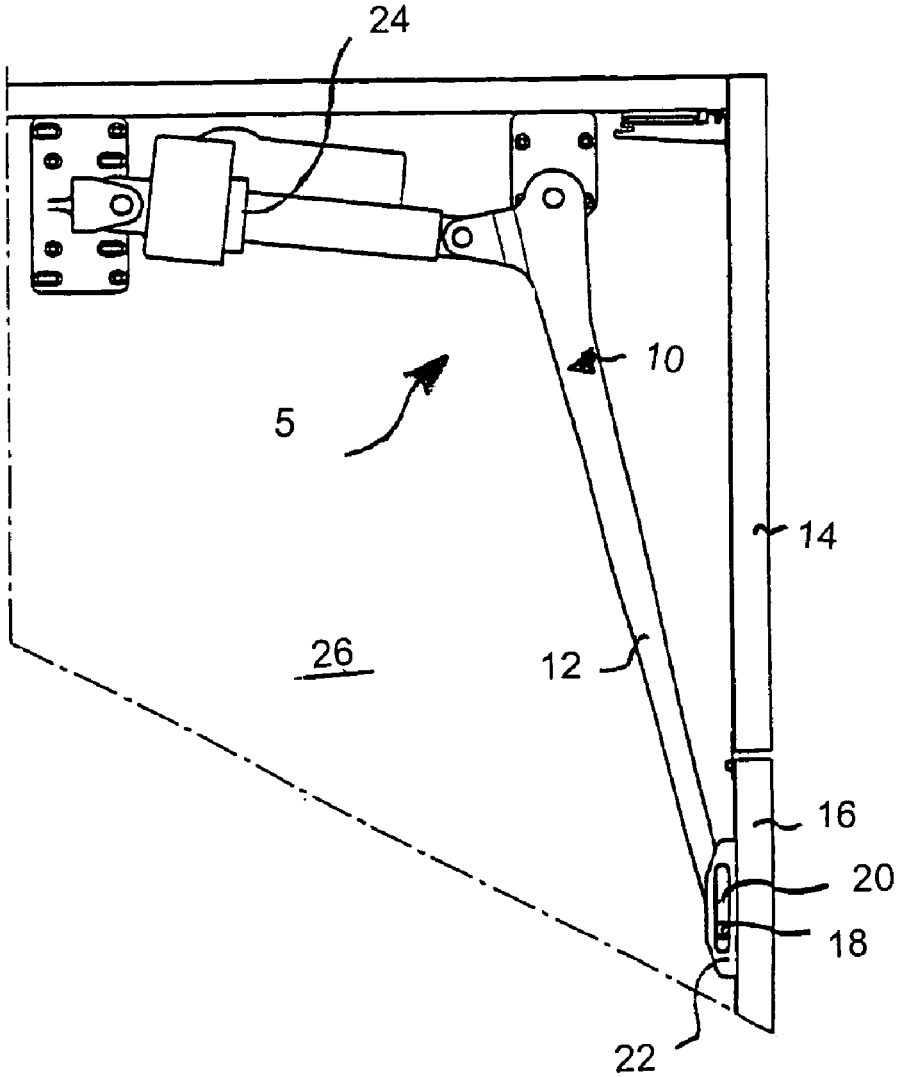
Figure 2:
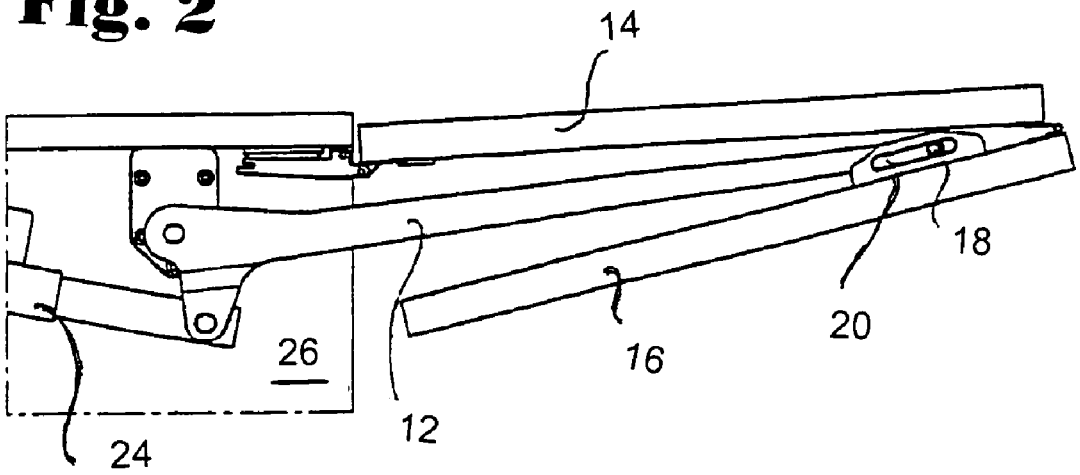
Figure 3:
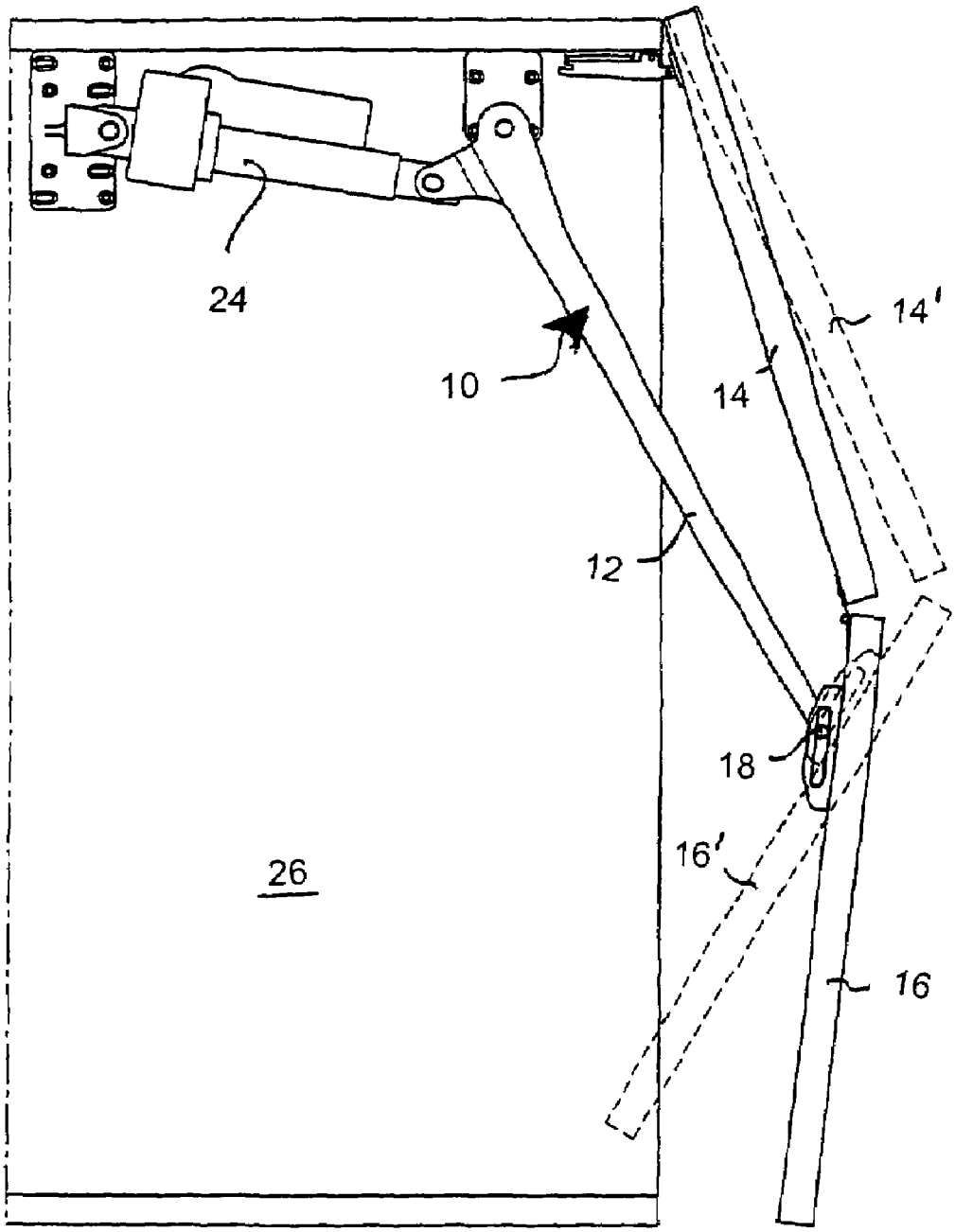
Figure 4:
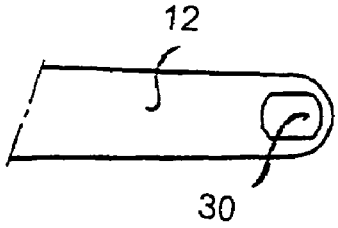
Figure 5:
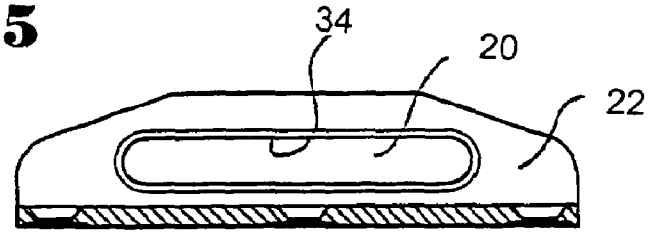
Figure 6:
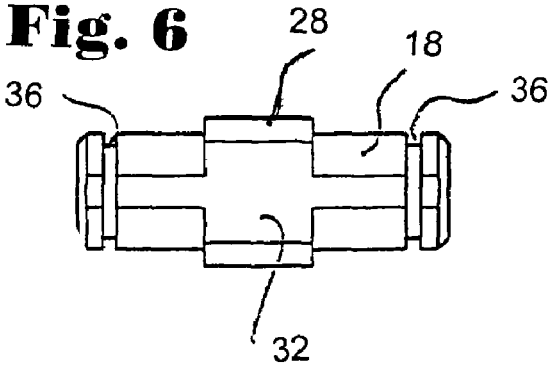

There are shown:

FIG. 1: a side view of a first embodiment of the lifting apparatus in accordance with the invention in the closed position of the folding flap connected thereto;

FIG. 2: a representation of the lifting apparatus corresponding to FIG. 1 in which the folding flap is located in its open position;

FIG. 3: a representation of the lifting apparatus corresponding to FIGS. 1 and 2 in which the folding flap is shown during its movement from the closed position into the open position;

FIG. 4: the front end region of the longer arm of the two-arm lever;

FIG. 5: a side representation of the support plate;

FIG. 6: a plan view of a bolt in individual representation; and

Figure 7:
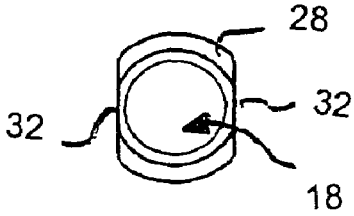

FIG. 7: a side view of the bolt in accordance with FIG. 6.

DESCRIPTION OF THE PREFERRED EMBODIMENTS

A side view of a cupboard or of a cupboard or chest element can be seen from FIG. 1 whose opening is closed by a folding flap consisting of two hingedly connected leaves 14 and 16 and whose front side wall has been removed in order to make a lifting apparatus 5 visible. The lifting apparatus 5 consists, as can be seen from FIGS. 1 and 2, substantially of a two-arm lever 10 whose shorter arm is hingedly connected to an electric motor for automatic pivoting up and down. The longer arm 12 of the two-arm lever 10 is connected to the lower panel or to the lower folding flap 16 in the end position of the pivot movement of the folding flap elements 14 and 16 while including an acute angle. The longer arm 12 thus extends approximately parallel to the lower panel 16 such that a bolt or hinged bolt 18 is held freely displaceable in an elongate hole-like guide 20 of a support plate 22 secured to the leaf panel 16. The electric motor 24 can therefore, without difficulty, bring the two-panel folding flap into its end position which is in each case bounded by the end faces of the lateral body parts 26 and by the open position of the upper folding door part or of the panel 14.

In the movement of the folding flap, as shown in FIG. 3, different movements are possible which are connected to the fact that the connection of the two-arm lever with the folding flap has two degrees of freedom and thus results in unstable kinematics. In FIG. 3, the desired opening path of the folding flap consisting of the folding flap parts 14 and 16 is shown as a solid line and another, unwanted position of the folding flap 1', 16' is shown by broken lines, wherein the lower panel 16' would abut the lateral body part 26.

To prevent such a position, the hinged bolt 18 is provided, as shown in FIGS. 6 and 7.

The hinged bolt 18 has a widened central part 28 which is held fixed against rotation in a complementary recess 30 at the front end of the longer arm 12 of the two-arm lever 10. The bolt 18 is provided on both sides with opposite flattening arrangements 32 whose spacing corresponds to the clearance of the elongate hole-like guide 20 which is arranged at the webs of the U-shaped base plate 22, which is shown by way of example in FIG. 5, and whose rims are covered by an elastic plastic liner 34, e.g. an insert or a seal. The hinged bolt 18 furthermore has grooves 36 at the end side for retaining washers (not shown).

The hinged bolt 18 designed in this manner is aligned at such an inclination in the guide 20 shown in FIG. 5 during the movement of the folding flap that the movement as a whole is braked such that due to the braking effect induced as a result of friction the folding flap carries out the opening or closing movement shown by solid lines in FIG. 3. An irritating abutting of the lower folding flap or folding door part 16 at the side body parts 26 is thereby effectively prevented.

The invention claimed is:

1. A lifting apparatus (5) in combination with a two-panel folding door which can be pivoted about horizontal axes, comprising a two-arm lever (10) which is pivotably supported about a horizontal pivot axis on a side body part (26) wherein a longer arm of said two-arm lever (12) is hinged to a lower panel (16) of the folding door, and a driver (24) having one end pivotably connected to the body part (26) and a second end connected to the lever (10), wherein the longer lever arm (12) of the two-arm lever (10) is hingedly and displaceably connected at a hinge point to the lower panel (16) and relative movement between the hinge point of the lever (10) and the lower panel (16) is damped by a spring force or a friction force.

2. A lifting apparatus in accordance with claim 1, wherein the longer lever arm (12) and the lower panel (16) are connected to one another by a bolt (18) secured to the longer lever arm (12), with the bolt (18) being rotatably and longitudinally displaceably guided in an elongate hole guide (20) of a support plate (22) secured to the lower panel.

3. A lifting apparatus in accordance with claim 2, wherein the bolt (18) has an oval shaped cross-section at least over a part of its length.

4. A lifting apparatus in accordance with claim 2, wherein the bolt (18) includes opposing flat sides at least over a part of its length.

5. A lifting apparatus in accordance with claim 2, wherein the elongate hold guide (20) includes rims cut out in the support plate (22), said rims being lined with an elastic plastic (34).

6. A lifting apparatus in accordance with claim 2, wherein the bolt includes a narrow diameter portion and wherein the elongate hole guide (20) has a width dimensioned to accommodate the narrow diameter portion of the bolt.

7. A lifting apparatus in accordance with claim 6, wherein the driver (24) is an electric motor.

8. A lifting apparatus in accordance with claim 3, wherein the elongate hold guide (20) includes rims cut out in the support plate (22), said rims being lined with an elastic plastic (34).

9. A lifting apparatus in accordance with claim 4, wherein the elongate hold guide (20) includes rims cut out in the support plate (22), said rims being lined with an elastic plastic (34).

10. A lifting apparatus in accordance with claim 3, wherein the bolt includes a narrow diameter portion and wherein the elongate hole guide (20) has a width dimensioned to accommodate the narrow diameter portion of the bolt.

11. A lifting apparatus in accordance with claim 4, wherein the bolt includes a narrow diameter portion and wherein the elongate hole guide (20) has a width dimensioned to accommodate the narrow diameter portion of the bolt.

12. A lifting apparatus in accordance with claim 5, wherein the bolt includes a narrow diameter portion and wherein the elongate hole guide (20) has a width dimensioned to accommodate the narrow diameter portion of the bolt.

13. A lifting apparatus in accordance with claim 8, wherein the bolt includes a narrow diameter portion and wherein the elongate hole guide (20) has a width dimensioned to accommodate the narrow diameter portion of the bolt.

14. A lifting apparatus in accordance with claim 9, wherein the bolt includes a narrow diameter portion and wherein the elongate hole guide (20) has a width dimensioned to accommodate the narrow diameter portion of the bolt.

15. A lifting apparatus in accordance with claim 1, wherein the driver (24) is an electric motor.

16. A lifting apparatus in accordance with claim 2, wherein the driver (24) is an electric motor.

17. A lifting apparatus in accordance with claim 3, wherein the driver (24) is an electric motor.

18. A door combination comprising:

a) a body (26), and a folding door hingedly attached to the body, the folding door including at least upper (14) and lower (16) panels hingedly connected to each other and pivotable about horizontal axes;

b) a lifting apparatus for opening said folding door including a lever (10) having a shorter arm and a longer arm (12), the lever (10) being pivotably mounted to the body, and the longer arm (12) being hingedly connected at an end portion to the lower panel (16) by a connector (18) which is pivotable and linearly displaceable relative to the lower panel (16), wherein movement of the connector (18) is damped by frictional or biasing force; and, c) drive means (24) for moving the lever (10), the drive means (24) having a first end attached to the body (26) and an opposite second end attached to the shorter arm of the lever (10).

19. The door combination of claim 18 wherein the drive means (24) includes an electric motor.

20. The door combination of claim 18 wherein the connector (18) includes a bolt (18) which is slidably disposed through at least one elongated slot (20) in a bracket (24) attached to a surface of the lower panel (16), said bolt (18) being non-rotatable relative to the longer arm (12).

21. The door combination of claim 20 wherein the bracket (22) has a U-shaped cross section and includes two elongated slots (20), each slot (20) being on a respective side of the U-shaped bracket (22) and having an end portion (36) of the bolt (18) disposed therethrough for relative pivotal and linear motion.

22. The door combination of claim 20 wherein the at least one elongated slot (20) is defined by an edge lined with an elastic plastic.

* * * * *